US008549876B2

(12) United States Patent
Kaart et al.

(10) Patent No.: US 8,549,876 B2
(45) Date of Patent: Oct. 8, 2013

(54) METHOD AND APPARATUS FOR COOLING A HYDROCARBON STREAM

(75) Inventors: Sander Kaart, The Hague (NL); Mark Antonius Kevenaar, The Hague (NL)

(73) Assignee: Shell Oil Company, Houston, TX (US)

( * ) Notice: Subject to any disclaimer, the term of this patent is extended or adjusted under 35 U.S.C. 154(b) by 848 days.

(21) Appl. No.: 12/524,181

(22) PCT Filed: Jan. 23, 2008

(86) PCT No.: PCT/EP2008/050732

§ 371 (c)(1),
(2), (4) Date: Jul. 23, 2009

(87) PCT Pub. No.: WO2008/090165

PCT Pub. Date: Jul. 31, 2008

(65) Prior Publication Data

US 2010/0024474 A1 Feb. 4, 2010

(30) Foreign Application Priority Data

Jan. 25, 2007 (EP) ..... 07101141

(51) Int. Cl.
*F25J 1/00* (2006.01)

(52) U.S. Cl.
USPC ..... 62/613; 62/611

(58) Field of Classification Search
USPC ..... 62/606, 51.2, 611, 612, 613, 616, 614
See application file for complete search history.

(56) References Cited

U.S. PATENT DOCUMENTS

| | | | | |
|---|---|---|---|---|
| 3,511,058 A | | 5/1970 | Becker | 62/9 |
| 3,763,658 A | | 10/1973 | Gaumer, Jr. et al. | 62/40 |
| 5,701,761 A | | 12/1997 | Prevost et al. | 62/613 |
| 5,893,274 A | * | 4/1999 | Nagelvoort et al. | 62/613 |
| 6,370,910 B1 | | 4/2002 | Grootjans et al. | 62/613 |
| 6,389,844 B1 | | 5/2002 | Klein Nagel Voort | 62/612 |
| 6,449,984 B1 | | 9/2002 | Paradowski | 62/613 |
| 6,978,638 B2 | * | 12/2005 | Brostow et al. | 62/623 |
| 2004/0244415 A1 | | 12/2004 | Paradowski | |
| 2006/0225461 A1 | | 10/2006 | Paradowski | 62/612 |
| 2008/0115532 A1 | * | 5/2008 | Jager | 62/620 |

FOREIGN PATENT DOCUMENTS

| | | | |
|---|---|---|---|
| EP | 1088192 | 4/2001 | F25J 1/02 |
| RU | 2060431 C1 | 5/1996 | |
| WO | 2004108865 A2 | 12/2004 | |
| WO | 2006061400 A1 | 6/2006 | |

OTHER PUBLICATIONS

Foerg, W: "Natural Gas Trade Routes and Liquefaction Processes", Apr. 2003, Oil Gas, Urban, Hamberg, Germany, pp. 206-210.

* cited by examiner

*Primary Examiner* — John Pettitt
*Assistant Examiner* — Ignacio E Landeros

(57) ABSTRACT

Method of cooling a hydrocarbon stream (10) such as natural gas, the method at least comprising the steps of (a) heat exchanging the hydrocarbon stream (10) against a first refrigerant stream (20) to provide a cooled hydrocarbon stream (30) and an at least partly evaporated refrigerant stream (40); (b) compressing the at least partly evaporated refrigerant stream (40) using one or more compressors (14, 16, 18) to provide a compressed refrigerant stream (50, 60, 70); (c) cooling the compressed refrigerant stream (50, 60, 70) after one or more of the compressors against ambient to provide a cooled compressed refrigerant stream (70*a*); (d) dynamically expanding the cooled compressed gaseous refrigerant stream (70*a*) to provide an expanded refrigerant stream (80); and (e) further cooling the expanded refrigerant stream (80) to provide an at least partially condensed refrigerant stream.

19 Claims, 3 Drawing Sheets

METHOD AND APPARATUS FOR COOLING A HYDROCARBON STREAM

The present application claims priority from European Patent Application 07101141.5 filed 23 Jan. 2007.

FIELD OF THE INVENTION

The present invention relates to a method and apparatus for cooling, optionally including liquefying, a hydrocarbon stream, particularly but not exclusively natural gas.

BACKGROUND OF THE INVENTION

Several methods of liquefying a natural gas stream thereby obtaining liquefied natural gas (LNG) are known. It is desirable to liquefy a natural gas stream for a number of reasons. As an example, natural gas can be stored and transported over long distances more readily as a liquid than in gaseous form, because it occupies a smaller volume and does not need to be stored at a high pressure.

U.S. Pat. No. 3,763,658 describes a refrigeration system and method for liquefying a feed stream by subjecting the feed stream to heat exchange with two refrigerants. After use, the second refrigerant is compressed in two compressor stages, but even with an intercooler and aftercooler, it requires passing through two propane exchangers before achieving at least partial condensation prior to a phase separator. This requires substantial condensing duty in the propane exchangers, taking away some of their cooling ability for cooling other streams.

It is an object of the present invention to improve the efficiency of a cooling process and apparatus. It is another object of the invention to increase the capacity of a hycrocarbon process.

SUMMARY OF THE INVENTION

In one aspect, the present invention provides a method of cooling a hydrocarbon stream such as natural gas, the method at least comprising the steps of:

(a) heat exchanging the hydrocarbon stream against a first refrigerant stream to provide a cooled hydrocarbon stream and an at least partly evaporated refrigerant stream;

(b) compressing the at least partly evaporated refrigerant stream using one or more compressors to provide a compressed refrigerant stream;

(c) cooling the compressed refrigerant stream, after one or more of the compressions, against ambient to provide a cooled compressed refrigerant stream;

(d) dynamically expanding the cooled compressed refrigerant stream of step (c) to provide an expanded refrigerant stream; and (e) further cooling the expanded refrigerant stream to provide an at least partially condensed refrigerant stream.

In a further aspect, the present invention provides an apparatus for cooling a hydrocarbon stream such as natural gas, the apparatus at least comprising:

a cooling stage for cooling the hydrocarbon stream against a first refrigerant stream to provide a cooled hydrocarbon stream and an at least partly evaporated refrigerant stream;

one or more compressors to compress the at least partly evaporated refrigerant stream;

one or more ambient coolers to cool the compressed refrigerant against ambient after one or more of the compressions by the compressors;

one or more dynamic expanders to expand the cooled and compressed gaseous stream and provide an expanded refrigerant stream;

a refrigerant cooling stage to further cool the expanded refrigerant stream and provide an at least partially condensed refrigerant stream;

wherein there is no further operative heat exchange means provided between the one or more ambient coolers and the one or more dynamic expanders.

BRIEF DESCRIPTION OF THE DRAWINGS

Embodiments of the present invention will now be described by way of example only, and with reference to the accompanying non-limiting drawings in which.

DETAILED DESCRIPTION OF THE INVENTION

Figure 1:
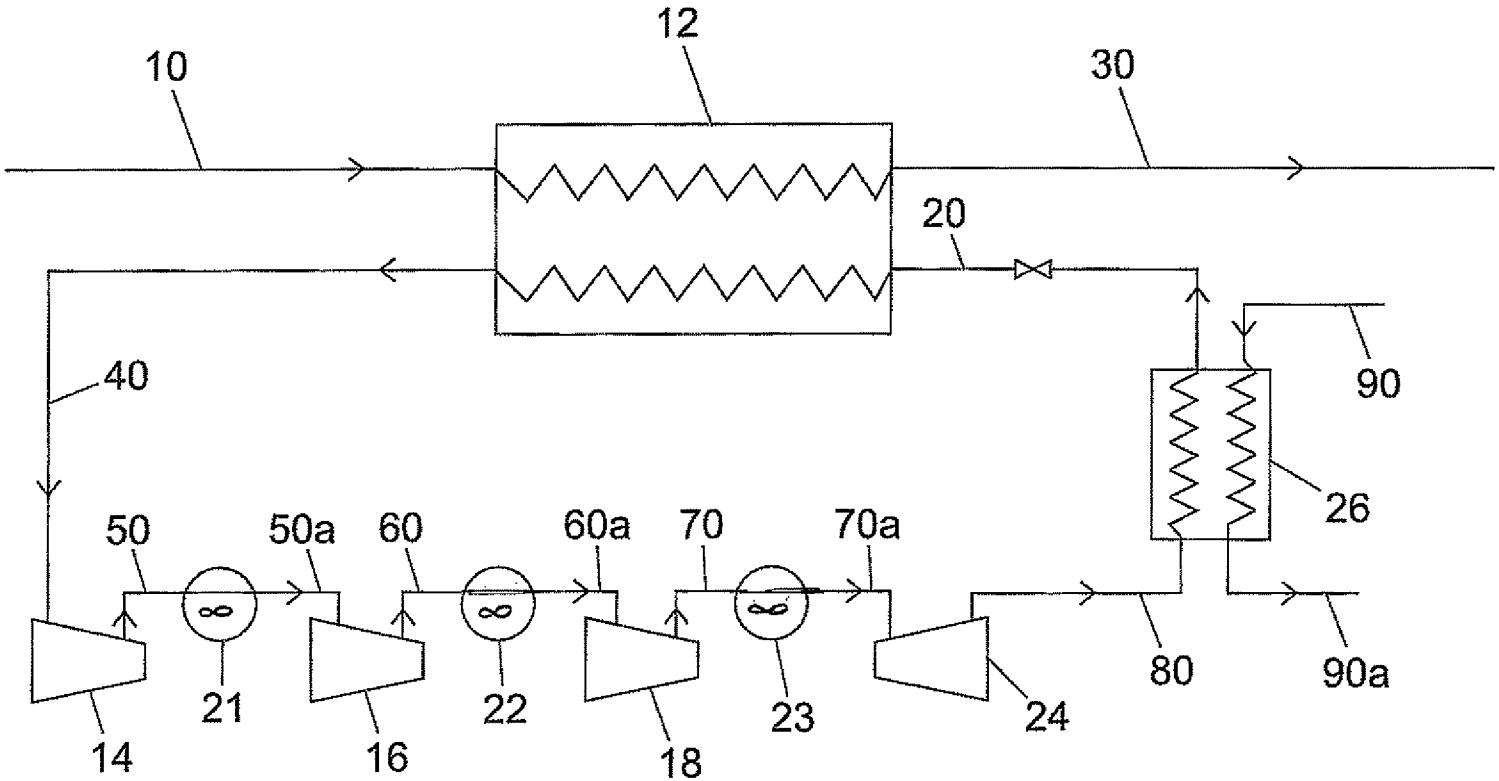
FIG. 1 is a first general scheme for a cooling process according to one embodiment of the present invention.

For the purpose of this description, a single reference number will be assigned to a line as well as a stream carried in that line. Same reference numbers refer to similar components.

Described are methods and apparatuses wherein a hydrocarbon stream is cooled against a refrigerant stream, which refrigerant stream is subsequently compressed, cooled against ambient, dynamically expanded before further cooling, and then further cooled, and optionally recirculated into the refrigerant stream against which the hydrocarbon stream is cooled.

An advantage of the present invention is that by cooling and then expanding the compressed refrigerant stream, at least some of the refrigerant stream is partially condensed, such that any further cooling requirement of the refrigerant stream (prior to its re-use) is reduced.

The dynamic expanding of the ambient-cooled compressed refrigerant before further cooling it, extracts work from the ambient-cooled compressed refrigerant stream, thereby reducing the enthalpy vested in the ambient-cooled compressed refrigerant stream and the heat to be extracted in any further cooling of the refrigerant stream. This helps to decrease the heat load on another refrigerant, heat exchanger or other method that is being used to further cool the previous refrigerant stream. In contrast, expanding over a valve or the like, typically no work is extracted and consequently enthalpy does not change.

If the designed available cooling capacity in the further cooling is actually not reduced by the same amount as by which the required capacity has reduced, the thus created excess capacity allows for further cooling of more of the refrigerant than before, such that more of the hydrocarbon stream may be cooled. Hence, the methods and apparatuses described herein may be applied to increase the capacity of a hydrocarbon cooling process and apparatus such as a natural gas liquefaction process.

In the present specification and claims, the term "cooling" is used where a temperature decrease results from heat exchange. A temperature decrease caused by expansion is not considered cooling, since no heat is exchanged with a cooling medium. For this purpose, the environment is considered a cooling medium. Instead, a temperature change by expansion may be caused by one or more of (i) extraction of work; (ii) phase change; and (iii) the so-called Joule-Thomson effect.

The methods and apparatuses described herein are particularly useful where any further cooling of the refrigerant stream by another refrigerant, heat exchanger or other method, is restricted or limited in size or capacity of cooling power.

The hydrocarbon stream may be any suitable gas stream to be treated, but is usually a natural gas stream obtained from natural gas or petroleum reservoirs. As an alternative the natural gas stream may also be obtained from another source, also including a synthetic source such as a Fischer-Tropsch process.

Usually a natural gas stream is comprised substantially of methane. Preferably the feed stream comprises at least 60 mol % methane, more preferably at least 80 mol % methane.

Depending on the source, the natural gas may contain varying amounts of hydrocarbons heavier than methane such as ethane, propane, butanes and pentanes as well as some aromatic hydrocarbons. The natural gas stream may also contain non-hydrocarbons such as $H_2O$, $N_2$, $CO_2$, $H_2S$ and other sulphur compounds, and the like.

If desired, the hydrocarbon stream containing the natural gas may be pre-treated before use. This pre-treatment may comprise removal of undesired components such as $CO_2$ and $H_2S$ or other steps such as pre-cooling, pre-pressurizing or the like. As these steps are well known to the person skilled in the art, they are not further discussed here.

Hydrocarbons heavier than methane also generally need to be removed from natural gas for several reasons, such as having different freezing or liquefaction temperatures that may cause them to block parts of a methane liquefaction plant. $C_{2-4}$ hydrocarbons can be used as a source of Liquefied Petroleum Gas (LPG).

The term "hydrocarbon stream" also includes a composition prior to any treatment, such treatment including cleaning, dehydration and/or scrubbing, as well as any composition having been partly, substantially or wholly treated for the reduction and/or removal of one or more compounds or substances, including but not limited to sulphur, sulphur compounds, carbon dioxide, water, and $C_{2+}$ hydrocarbons.

The (first) refrigerant of the first refrigerant stream may be a single component, such as propane, or a mixed refrigerant comprising two or more of the components selected from the group: nitrogen, methane, ethane, ethylene, propane, propylene, butanes, pentanes.

Compressors and expanders for compressing and expanding the first refrigerant stream are known in the art. The expansion of the first refrigerant stream is preferably isentropic. This maximizes the work extracted from the refrigerant stream and thereby maximally lowers the enthalpy vested therein.

Optionally, the cooling of the hydrocarbon stream by the methods described herein includes liquefying a hydrocarbon stream, such as to provide a liquefied natural gas. Methods of liquefying a hydrocarbon stream are known in the art, such as those shown in U.S. Pat. No. 6,370,910 B1 and U.S. Pat. No. 6,389,844 B1, and are not further described herein. In one embodiment of the present invention, the cooling of the hydrocarbon stream in step (a) is a cooling stage in a method of liquefying a hydrocarbon stream such as natural gas. Preferably, the hydrocarbon stream has undergone a first, initial or pre-cooling stage or step, and then is further cooled according to one of the methods described herein to liquefy the hydrocarbon stream in a manner known in the art.

FIG. 1 shows a general scheme for a cooling a hydrocarbon stream such as natural gas. It shows a hydrocarbon stream containing natural gas 10, which stream 10 may have been pre-treated to separate out at least some heavier hydrocarbons and impurities such as carbon dioxide, nitrogen, helium, water, sulphur and sulphur compounds, including but not limited to acid gases.

The hydrocarbon stream 10 passes through a cooling stage 12 for heat exchanging, i.e. cooling, against an incoming first refrigerant stream 20, so as to provide a cooled hydrocarbon stream 30. The cooling stage 12 may comprise one or more heat exchangers, which heat exchangers may be arranged in parallel, series or both, and may comprise one or more sections, steps or levels, in particular, pressure levels. Many arrangements for heat exchangers in order to provide cooling to a hydrocarbon stream are known in the art.

The cooling effected by the cooling stage 12 may be to provide a cooled hydrocarbon stream 30, which is liquefied, such as liquefied natural gas.

Optionally, the hydrocarbon stream 10 may be pre-cooled prior to the cooling stage 12.

In one embodiment of the present invention, the cooling stage 12 provides a cooled hydrocarbon stream 30 having a temperature of less than 0° C., preferably less than −20° C. Where the cooling stage 12 involves liquefaction of the hydrocarbon stream such as natural gas, the cooled hydrocarbon stream 30 may have a temperature below −100° C., preferably below −150° C.

The cooling stage 12 heats the incoming first refrigerant stream 20 such that it creates an at least partly evaporated first refrigerant stream 40, which is, usually wholly or substantially evaporated. The refrigerant is preferably a mixed refrigerant as hereinbefore described.

The at least partly evaporated first refrigerant stream 40 from the cooling stage 12 is passed to a first compressor 14, which compresses the refrigerant in a manner known in the art, to provide a first compressed first refrigerant stream 50, which is then cooled by one or more coolers known in the art. Such coolers can be water and/or air coolers, and as an example first cooler 21 is shown in FIG. 1. The first cooled first compressed refrigerant stream **50*a* then enters a second compressor 16, to provide a second compressed first refrigerant stream 60, which is again cooled in a manner known in the art, and represented in FIG. 1 by a second cooler 22, to provide a second cooled compressed first refrigerant stream 60*a***.

Conventionally, a refrigerant stream, after one or more compression steps such as the first two shown in FIG. 1, is then further cooled and at least partially condensed without any further significant pressure change. One conventional example of such cooling is shown in U.S. Pat. No. 3,763,658, and involves cooling against another refrigerant circuit or cycle, usually by passage through another heat exchanger, for example as part of a pre-cooling stage in a manner known in the art.

However, considerable cooling power or duty is required to affect the conventional at least partial condensation of the refrigerant in a compressed state. Such cooling power is available in some conventional arrangements in a liquefaction plant, especially large-scale plants, but there are many arrangements not able to give such cooling power to at least partially condense a refrigerant, or which may only be able to give such cooling power in certain situations. Such arrangements may not make the liquefaction plant be most efficient or effective.

The second cooled compressed first refrigerant stream **60*a* is not then further cooled, but instead now enters a third compressor 18 to provide a third compressed first refrigerant stream 70, which is then cooled for example by a third cooler 23, which can be an air or water cooler like cooler 21 and 22. The so formed third cooled compressed first refrigerant stream 70***a* is then passed into an expander 24. The expander 24 provides a dynamically expanded refrigerant stream 80 at a pressure that is close to the pressure of stream 60, prior to the last compression step.

Preferably, the various refrigerant streams downstream of the first compressor in the one or more compressors (e.g. compressor 14) prior to the dynamic expanding (e.g. streams 50, 50*a*, 60, 60*a*, and 70) are all free from any liquid phase (thus the streams may be fully in vapour phase or possibly a supercritical phase which is neither a vapour nor a liquid phase), while the dynamically expanded refrigerant stream 80 is at least partially condensed.

By expansion, the temperature of the refrigerant is reduced. Because the refrigerant now has a lower specific enthalpy, less cooling power is required (from another refrigerant) to further cool, particularly to condense or further condense, the refrigerant to a position where it is useable, usually re-useable or recyclable, in a heat exchanger.

Preferably, the expansion of the third cooled compressed first refrigerant stream 70*a* causes the first refrigerant to pass through its dew point line, and thereby provides an at least partially condensed refrigerant stream.

In FIG. 1, further cooling of the expanded refrigerant stream 80 is provided by a refrigerant cooling stage 26. The refrigerant cooling stage 26 may comprise one or more heat exchangers in parallel, series or both, and arrangements of heat exchangers for providing cooling to a refrigerant stream are known in the art.

The refrigerant cooling stage 26 may also provide cooling to one or more other lines, streams or parts of a liquefaction plant. In general, the refrigerant cooling stage 26 has a second refrigerant stream 90, which passes into the refrigerant cooling stage 26 to cool the expanded refrigerant stream 80 and create a warmed second refrigerant stream 90*a*.

In the example shown in FIG. 1, the further cooled first refrigerant stream from the refrigerant heat exchanger 26 is wholly or substantially condensed, and ready for recirculation as the first refrigerant stream 20 for entry into the cooling stage 12.

Figure 2:
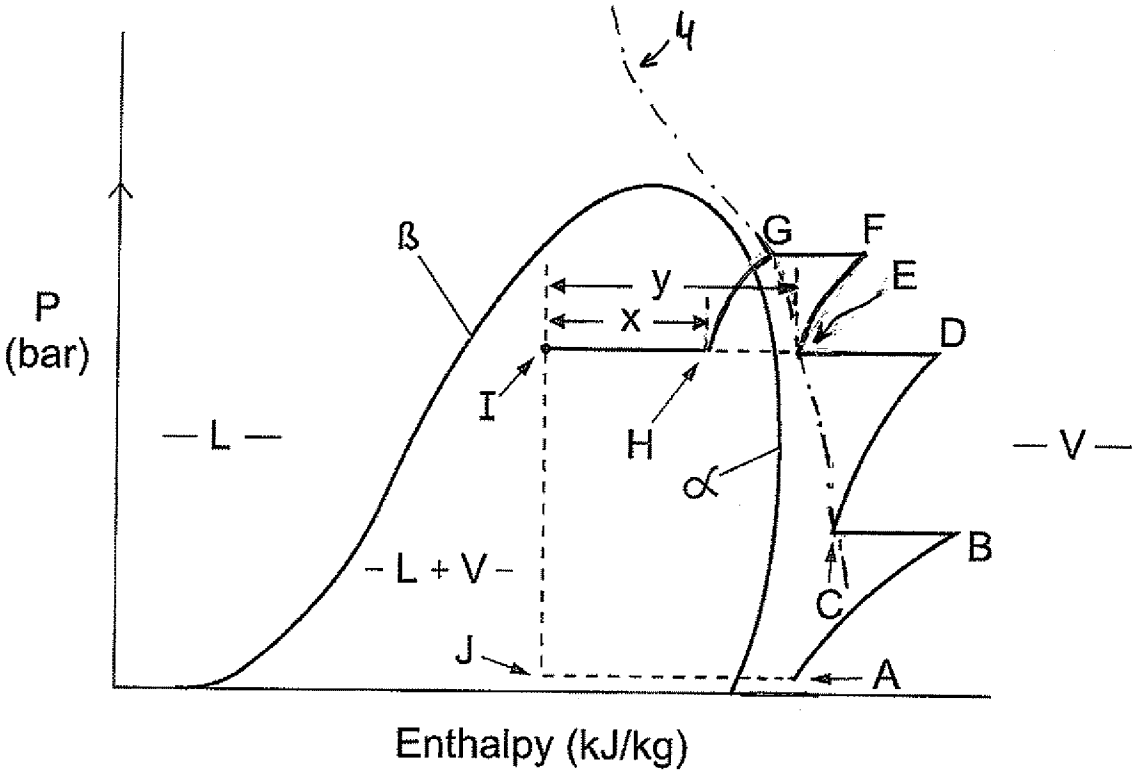
FIG. 2 is a graph of a P-H diagram for the circulation of a refrigerant stream such as that in the scheme shown in FIG. 1.

The present invention is further illustrated by FIG. 2, which shows a pressure (P) versus enthalpy (H) diagram for a typical multi-component or 'mixed' hydrocarbon refrigerant suitable for use as the first refrigerant 20 in FIG. 1.

The diagram in FIG. 2 shows the dew point line (a) and the bubble point line (β) for the mixed refrigerant, generally creating a vapour-only phase section (V), a liquid and vapour phase section (L+V), and a liquid-only phase section (L).

Starting at point A in FIG. 2 where the refrigerant has been used and passed out of its cooling stage (such as line 40 in FIG. 1), such as from a cryogenic heat exchanger, the refrigerant is first compressed along line AB by a first compressor (first compressor 14), following which it is cooled (first cooler 21) along line BC. The refrigerant is then further compressed in second compressor 16, along line CD, following which it is further cooled (second cooler 22) along line DE.

Conventionally, such as shown in U.S. Pat. No. 3,763,658, the refrigerant is then further cooled and substantially condensed (i.e. continuing directly along line E-I shown in dashed line in FIG. 2), usually by heat exchange with another refrigerant, such as a single component hydrocarbon refrigerant undergoing vaporisation. Thus, the cooling duty required for cooling and condensing the refrigerant between point E and point I is labelled as "y" in FIG. 2, and is the conventional cooling duty required in a single cooling process.

As now proposed, the refrigerant at point E is further compressed by another compressor (such as the third compressor 18 in FIG. 1) along line EF, following which it is cooled against ambient along line FG in a manner known in the art (third cooler 23), and then expanded along line GH (e.g. using dynamic expander 24). In such a dynamic expansion, the refrigerant passes across its dew point line (a), such that it is at least partially condensed at point H. By reaching point H, the further cooling duty required in order to bring the refrigerant to the same required refrigerant condition at point I, is labelled as "x" in FIG. 2.

It is clear that x is smaller than y. This means the duty transferred to the second refrigerant is smaller which will result in reduced power consumption or alternatively increased production at the same power consumption.

From point I, the refrigerant is expanded prior to its use at point J in a heat exchanger, leading to its evaporation to point A in a manner known in the art.

For the sake of completeness, a dot-dashed line 4 is depicted in FIG. 2, to schematically represent the relationship between P and H for the first refrigerant at the temperature after cooling against ambient (such as in coolers 21, 22, 23 of FIG. 3) assuming that the temperature is the same after each of these cooling steps. Hence, points C, E, and G are assumed to lie on line 4.

Figure 3:
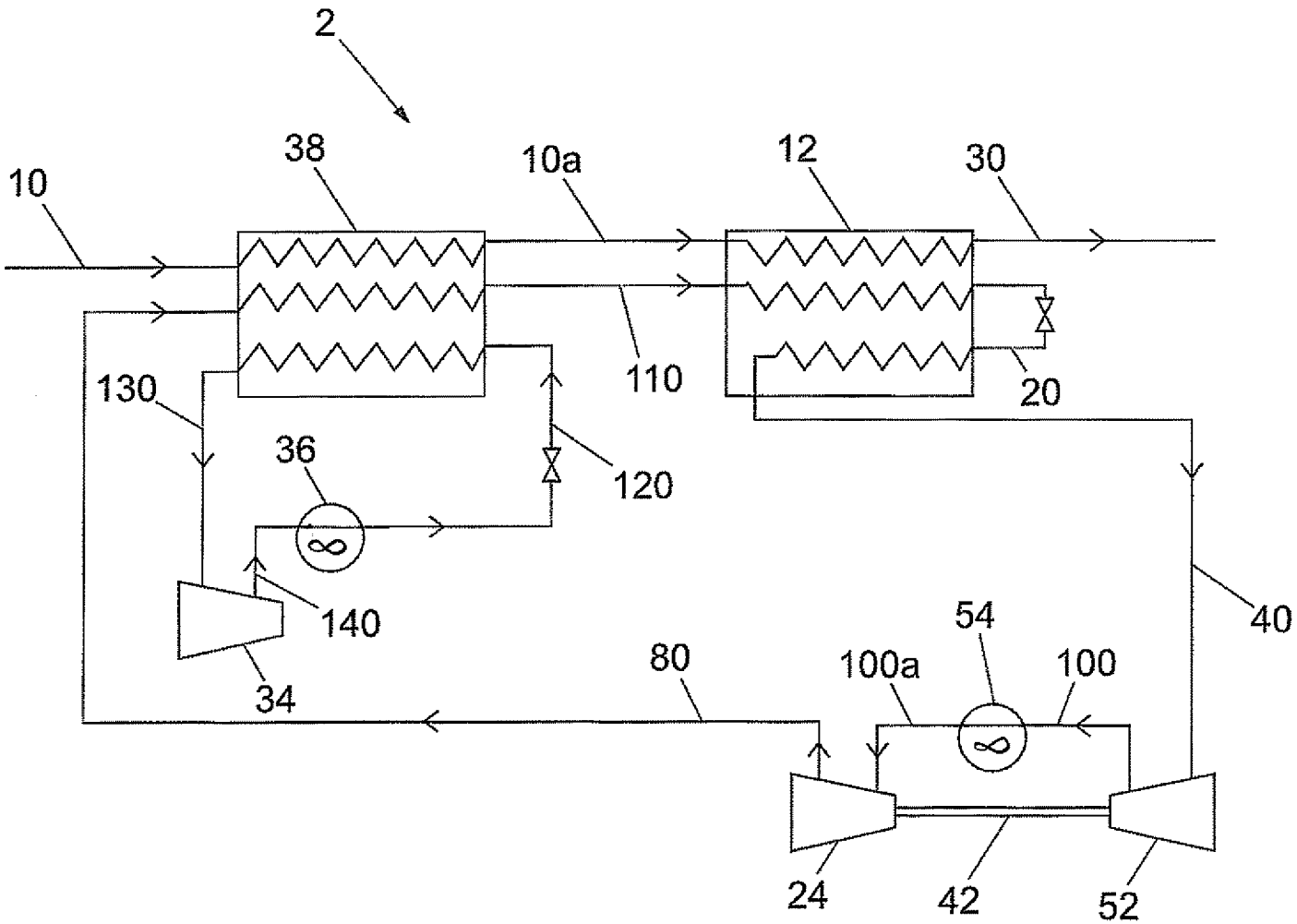
FIG. 3 is a second general scheme for a liquefying process according to another embodiment of the present invention.

FIG. 3 shows the use of a second scheme for the present invention in a liquefaction plant 2. In FIG. 3, the hydrocarbon stream 10 is initially cooled in a first cooling stage 38, wherein a cooled hydrocarbon stream 10*a* is provided at a temperature of less than 0° C., preferably between −20° C. and −50° C. The cooled hydrocarbon stream 10*a* is then passed into a second cooling stage such as the cooling stage 12 described above for FIG. 1, to provide a cooled hydrocarbon stream 30, preferably being a liquefied hydrocarbon stream such as liquefied natural gas, and usually provided at a temperature of less than −100° C., preferably below −150° C.

In one embodiment of the present invention, the first cooling stage 38 is a pre-cooling stage of a two stage liquefaction plant, and the (second) cooling stage 12 is a liquefaction stage, generally involving one or more cryogenic heat exchangers. One example of such an arrangement is shown in EP 1 088 192 B1.

In a manner similar to that described above in FIG. 1, cooling in the cooling stage 12 is provided by an incoming first refrigerant stream 20 (after its own cooling passage through the cooling stage 12 and expansion in a manner known in the art), which is warmed by heat exchange with the pre-cooled hydrocarbon stream 10*a*, to provide an at least partly evaporated first refrigerant stream 40.

The at least partly evaporated first refrigerant stream 40 is passed through one or more compressors (represented as compressor 52 in FIG. 3), which compresses the first refrigerant in a manner known in the art, to provide a compressed first refrigerant stream 100. After one or more of the compressions, preferably after each compression, the compressed first refrigerant is cooled by one or more coolers known in the art. Such coolers can be water and/or air coolers, and are represented in FIG. 3 by cooler 54.

The present invention may involve any number of compressors and any number of coolers, optionally not being equal. This includes two, three, four or more compressors and/or coolers, optionally being one more compressor and cooler than conventionally used to affect the extra compression and cooling desired prior to the expansion step as shown in FIG. 2. If desired or necessary, additional heat exchange could be provided by one or more of the post-compression coolers, such as by installing additional heat exchanger area in a cooler, to provide the desired amount of cooling to the refrigerant prior to expansion.

In FIG. 3, the cooled compressed first refrigerant stream 100*a* from the cooler(s) 54 then enters an expander 24 prior to any further cooling. The expander 24 provides an expanded first refrigerant stream 80, which is then cooled by passage through the first cooling stage 38 in a manner known in the art, to provide a further cooled, optionally fully condensed, first refrigerant stream 110 prior to the cooling stage 12 (wherein it can be further cooled against itself, expanded, and then is ready again as the incoming first refrigerant stream 20).

Cooling in the first cooling stage 38 can be provided by a third refrigerant circuit having a third refrigerant stream 120 to provide cooling in the first cooling stage 38. The warmed third refrigerant stream 130 therefrom is compressed in a compressor 34 to provide a compressed third refrigerant stream 140, followed by cooling in a cooler 36 to provide the third refrigerant stream 120 ready for reuse. The compressor 34 and the cooler 36 may comprise one or more compressors or coolers, in a manner known in the art. The third refrigerant may be a single component refrigerant such as propane, or a mixed refrigerant as hereinbefore discussed.

The arrangement shown in FIG. 3 has a particular advantage where the cooling power of the third refrigerant stream 120 is reduced, and/or may not be sufficient to provide the complete cooling power required to at least partially condense the compressed first refrigerant stream 100 and provide the desired cold energy in the first refrigerant stream 20.

This is because in the arrangement shown in FIG. 3, some of the cooling power or duty that was conventionally required to be supplied or effected by the third refrigerant stream 120, is provided or replaced by the expansion of the compressed cooled first refrigerant stream 100*a*. This provides a number of particular advantages.

Firstly, work created by the expansion of the first refrigerant in the expander 24 can be used to at least partly deliver power to a compressor, such as the compressor 52, optionally by direct linkage such as a power shaft 42, or by a geared coupling. Efficiency is achieved by this use of power to assist another unit.

Secondly, in the arrangement shown in FIG. 3, some of the cooling duty required for the first refrigerant is shifted from the third refrigerant stream 120 (passing through the first cooling stage 38), and passed to one or more cooler(s) represented in FIG. 3 by cooler 54. This reduces or 'unloads' some of the cooling power or duty hitherto required of the third refrigerant stream 120 (to provide the same level or amount of condensed first refrigerant as conventionally provided), enabling the same cooling power of third refrigerant stream 120 to provide more cooling to the first refrigerant stream and/or to the hydrocarbon stream 10. Thus, the first refrigerant stream 20 either has more cooling power for the second cooling stage 12, which is usually the main cooling stage of a liquefaction plant, and/or the cooled hydrocarbon stream 10*a* is already cooler prior to entry in the second cooling stage 12.

The herein proposed methods may decrease the temperature of the refrigerant stream 110 (and/or the pre-cooled hydrocarbon stream 10*a*) between the first cooling stage 38 and the cooling stage 12, and/or it may increase the amount of condensed material in the first refrigerant stream 20.

Alternatively, where the cooling power of the third refrigerant stream 120 is insufficient to cool and condense the first refrigerant to a desired level or amount prior to its use in the cooling stage 12, the present invention provides a method of compensating for the limited available refrigeration power of the third refrigerant stream 120.

The following table provides typical pressure, temperature and phase compositions from a working example of the present invention based on the arrangement shown in FIG. 3.

| Line | Pressure(bar) | Temperature(° C.) | Phase composition |
|---|---|---|---|
| 10 | 72.65 | 45.50 | Vapor |
| 10a | 71.40 | −31.22 | Vapor |
| 30 | 65.90 | −150.86 | Liquid |
| 110 | 46.00 | −31.22 | V/L |
| 40 | 3.90 | −33.21 | Vapor |
| 100 | 94.80 | 99.00 | Vapor |
| 100a | 94.30 | 40.50 | Vapor |
| 80 | 47.40 | 8.55 | V/L |

The person skilled in the art will understand that the present invention can be carried out in many various ways without departing from the scope of the appended claims.

What is claimed is:

1. Method of cooling a hydrocarbon stream, the method comprising the steps of:

(a) heat exchanging the hydrocarbon stream against a first refrigerant stream in a heat exchanger to provide a cooled hydrocarbon stream and an at least partly evaporated refrigerant stream;

(b) compressing the at least partly evaporated refrigerant stream using one or more compressors to provide a compressed refrigerant stream;

(c) cooling the compressed refrigerant stream in at least one ambient cooler, after one or more of the compressions, against ambient to provide an ambient-cooled compressed refrigerant stream;

(d) dynamically expanding the ambient-cooled compressed refrigerant stream of step (c) in at least one dynamic expander before it is further cooled to provide an expanded refrigerant stream; and (e) further cooling the expanded refrigerant stream to provide an at least partially condensed refrigerant stream;

wherein there is no further heat exchanger provided between the at least one ambient cooler and the at least one dynamic expander.

2. Method according to claim 1, wherein the partially condensed refrigerant stream provided by step (e) is recirculated as the first refrigerant stream in step (a).

3. Method according to claim 1, wherein the expanded stream is further cooled in step (e) by heat exchange against a second refrigerant stream in a heat exchanger.

4. Method according to claim 1, wherein the refrigerant of the first refrigerant stream is a mixed refrigerant.

5. Method according to claim 1, wherein the expanded refrigerant stream is partially liquid after the expansion of the cooled compressed refrigerant stream in step (d).

6. Method according to claim 1, wherein step (b) involves two or more compressors.

7. Method according to claim 1, wherein the cooling of the hydrocarbon stream in step (a) comprises a cooling stage in a method of liquefying a hydrocarbon stream.

8. Method according to claim 1, wherein the hydrocarbon stream is liquefied in step (a).

9. Apparatus for cooling a hydrocarbon stream, the apparatus at least comprising:

a cooling stage for cooling the hydrocarbon stream against a first refrigerant stream in a heat exchanger to provide a cooled hydrocarbon stream and an at least partly evaporated refrigerant stream;

one or more compressors to compress the at least partly evaporated refrigerant stream to provide a compressed refrigerant stream;

at least one ambient cooler to cool the compressed refrigerant against ambient to provide an ambient-cooled compressed refrigerant stream;

at least one dynamic expander to expand the ambient-cooled compressed stream and provide an expanded refrigerant stream;

a refrigerant cooling stage to further cool the expanded refrigerant stream and provide an at least partially condensed refrigerant stream;

wherein the ambient-cooled compressed refrigerant stream is dynamically expanded in the at least one dynamic expander before it is further cooled in the refrigerant cooling stage; and wherein there is no further heat exchanger provided between the at least one ambient cooler and the at least one dynamic expander.

10. Apparatus as claimed in claim 9, wherein the refrigerant cooling stage involves a second refrigerant stream to provide cooling to the expanded refrigerant stream.

11. Method according to claim 2, wherein the expanded stream is further cooled in step (e) by heat exchange against a second refrigerant stream in a heat exchanger.

12. Method according to claim 2, wherein the refrigerant of the first refrigerant stream is a mixed refrigerant comprising two or more of the components selected from the following group: nitrogen, methane, ethane, ethylene, propane, propylene, butanes, and pentanes.

13. Method according to claim 3, wherein the refrigerant of the first refrigerant stream is a mixed refrigerant comprising two or more of the components selected from the following group: nitrogen, methane, ethane, ethylene, propane, propylene, butanes, and pentanes.

14. Method according to claim 1, comprising:

(f) further expanding the at least partially condensed refrigerant stream from step (e) before using the condensed refrigerant stream as the first refrigerant stream in the heat exchanger of step (a) for heat exchanging against the hydrocarbon stream.

15. Method according to claim 1, wherein said cooling of the compressed refrigerant stream in said at least one ambient cooler in step (c) does not condense any of the compressed refrigerant stream.

16. Method according to claim 4, wherein said cooling of the compressed refrigerant stream in said at least one ambient cooler in step (c) does not condense any of the compressed refrigerant stream.

17. Method according to claim 5, wherein said cooling of the compressed refrigerant stream in said at least one ambient cooler in step (c) does not condense any of the compressed refrigerant stream.

18. Method according to claim 4, wherein said mixed refrigerant comprises two or more of the components selected from the following group: nitrogen, methane, ethane, ethylene, propane, propylene, butanes, and pentanes.

19. Method according to claim 4, wherein the mixed refrigerant has a dew point line in a pressure versus enthalpy phase diagram for the mixed refrigerant, wherein during said dynamically expanding, the ambient-cooled compressed refrigerant stream passes across the dew point line such that the ambient-cooled compressed refrigerant stream is at least partially condensed by said dynamically expanding.

* * * * *